US012102247B2

(12) United States Patent
Angel et al.

(10) Patent No.: US 12,102,247 B2
(45) Date of Patent: Oct. 1, 2024

(54) NON-SQUARE RECTANGULAR FLOORING TILES AND METHODS FOR CUTTING SAME

(71) Applicant: Interface, Inc., Atlanta, GA (US)

(72) Inventors: Jorge Del Angel, LaGrange, GA (US); William Nathan Jones, West Point, GA (US)

(73) Assignee: Interface, Inc., Atlanta, GA (US)

( * ) Notice: Subject to any disclaimer, the term of this patent is extended or adjusted under 35 U.S.C. 154(b) by 16 days.

(21) Appl. No.: 17/735,783

(22) Filed: May 3, 2022

(65) Prior Publication Data

US 2022/0346582 A1 Nov. 3, 2022

Related U.S. Application Data

(60) Provisional application No. 63/183,491, filed on May 3, 2021.

(51) Int. Cl.
*A47G 27/02* (2006.01)

(52) U.S. Cl.
CPC ..... *A47G 27/0275* (2013.01)

(58) Field of Classification Search
CPC ..... A47G 27/0275
USPC ..... 83/13
See application file for complete search history.

(56) References Cited

U.S. PATENT DOCUMENTS 2,396,039 A 3/1946 Burton et al.
3,352,733 A * 11/1967 Kruce ..... B32B 5/26 156/302
3,760,046 A 9/1973 Schwartz et al.
3,819,462 A 6/1974 Starr et al.
3,825,464 A 7/1974 Crowley
3,875,716 A * 4/1975 Eusemann ..... E04F 15/02 52/311.2
4,010,301 A 3/1977 Anderson et al.
4,010,302 A 3/1977 Anderson et al.
4,082,874 A * 4/1978 Traylor, Jr. ..... D06M 15/693 428/56
4,089,140 A 5/1978 McIntyre et al.
4,140,071 A * 2/1979 Gee ..... D05C 17/02 428/95

(Continued)

FOREIGN PATENT DOCUMENTS

CN 102203340 9/2011
DE 102008058751 A1 6/2010

(Continued)

OTHER PUBLICATIONS

Louis, "Everything You Need to Know About Laminate Flooring", Available Online at: http://ezinearticles.com/Everything-You-Need-to-Know-About-Laminate-Flooring&id=2433607, Accessed from Internet on Oct. 4, 2013, pp. 1-2.

(Continued)

*Primary Examiner* — Omar Flores Sanchez
(74) *Attorney, Agent, or Firm* — Kilpatrick Townsend & Stockton LLP

(57) ABSTRACT

Methods of cutting a flooring web into rectangular flooring tiles such that at least one vertical cut along the length of the web defines a shorter edge of the rectangular tiles and horizontal cuts across the width of the web define the longer edges of the rectangular tiles.

18 Claims, 12 Drawing Sheets
(8 of 12 Drawing Sheet(s) Filed in Color)

(56) References Cited

U.S. PATENT DOCUMENTS 4,242,389 A * 12/1980 Howell ..... D06N 7/0044 428/95
4,269,881 A 5/1981 Johnson et al.
4,273,890 A 6/1981 Hirzy
4,303,732 A 12/1981 Torobin
4,439,476 A 3/1984 Guild
4,689,256 A 8/1987 Slosberg et al.
4,737,764 A 4/1988 Harrison
4,872,930 A 10/1989 Kajikawa et al.
4,931,129 A 6/1990 Bartlett et al.
5,160,775 A 11/1992 Yamada
5,198,277 A * 3/1993 Hamilton ..... B32B 7/12 428/95
5,204,155 A 4/1993 Bell et al.
RE34,951 E 5/1995 Slosberg et al.
5,534,348 A 7/1996 Miller et al.
5,560,972 A * 10/1996 Blakely ..... D06N 7/0076 428/95
5,962,349 A * 10/1999 Mizukami ..... D04B 21/16 66/196
6,203,879 B1 3/2001 Desai
6,291,048 B1 9/2001 Jerdee et al.
6,305,688 B1 10/2001 Waroway
6,307,207 B1 10/2001 Burbank
6,689,443 B2 * 2/2004 Kobayashi ..... B32B 25/10 428/56
6,706,132 B2 * 3/2004 Coffin ..... E01F 15/0461 156/196
6,838,147 B2 1/2005 Burns, Jr. et al.
6,841,216 B2 1/2005 Daniel
6,908,656 B2 6/2005 Daniel et al.
7,018,492 B1 3/2006 Mumm et al.
7,083,841 B2 8/2006 Oakey et al.
7,182,989 B2 2/2007 Higgins
7,297,385 B2 11/2007 Daniel et al.
7,374,808 B2 5/2008 Sellman, Jr. et al.
7,423,069 B2 9/2008 Buszard et al.
7,464,510 B2 12/2008 Scott et al.
7,721,502 B2 5/2010 Scott et al.
7,993,717 B2 8/2011 O'Connor
8,083,875 B2 12/2011 Sheppard et al.
8,381,473 B2 2/2013 Scott et al.
8,468,772 B2 6/2013 Oakey
8,613,406 B2 * 12/2013 Jones ..... B60N 3/046 428/920
8,739,381 B2 * 6/2014 Jones ..... B60N 3/042 428/92
9,340,982 B2 5/2016 Rainey
9,376,766 B2 * 6/2016 Hobbs ..... B60N 3/048
10,443,188 B2 10/2019 De Jonge
RE48,544 E 5/2021 Oakey
2001/0030011 A1 10/2001 Nasli-Bakir et al.
2002/0034606 A1 3/2002 Miller et al.
2002/0034607 A1 3/2002 Stoyles
2002/0046433 A1 4/2002 Sellman, Jr. et al.
2002/0119281 A1 8/2002 Higgins et al.
2002/0132085 A1 9/2002 Higgins et al.
2002/0142126 A1 10/2002 Higgins et al.
2003/0170420 A1 9/2003 Higgins
2003/0190450 A1 10/2003 Daniel et al.
2003/0207071 A1 * 11/2003 Beistline ..... D06N 7/0063 428/88
2004/0022985 A1 2/2004 Higgins et al.
2004/0030011 A1 2/2004 Buszard et al.
2004/0030733 A1 2/2004 Bell
2004/0062899 A1 4/2004 Kobayashi et al.
2004/0185219 A1 * 9/2004 Guess ..... A47G 27/0275 428/85
2004/0258870 A1 12/2004 Oakey et al.
2005/0037175 A1 2/2005 Loyd et al.
2005/0053760 A1 3/2005 Fowler
2005/0079316 A1 4/2005 Kobayashi
2005/0112320 A1 5/2005 Wright
2005/0281977 A1 12/2005 Mashburn
2006/0076100 A1 4/2006 Doney
2006/0251853 A1 11/2006 Ingram, III
2007/0087159 A1 4/2007 Wright
2007/0087160 A1 4/2007 Wright
2007/0254131 A1 11/2007 Shail et al.
2008/0113146 A1 5/2008 Wright et al.
2008/0213529 A1 9/2008 Gray et al.
2008/0233336 A1 9/2008 Giannopoulos et al.
2008/0317997 A1 12/2008 Wright
2009/0233040 A1 9/2009 Baumgartner et al.
2009/0304974 A1 * 12/2009 Tick ..... B44F 3/00 428/196
2010/0051169 A1 3/2010 Sheppard et al.
2010/0051745 A1 3/2010 Jones et al.
2010/0170991 A1 7/2010 Hobbs et al.
2010/0330327 A1 12/2010 Oakey
2011/0226901 A1 9/2011 Gonnsen
2012/0110804 A1 5/2012 Hussmann
2012/0117777 A1 5/2012 Jones et al.
2012/0233951 A1 9/2012 Phillips
2013/0216763 A1 8/2013 Oakey
2013/0230682 A1 * 9/2013 Duncan ..... A47G 27/0275 428/44
2014/0037885 A1 * 2/2014 Oakey ..... E04F 15/02 428/85
2014/0260032 A1 * 9/2014 Rainey ..... E04F 13/0871 52/311.1
2015/0299946 A1 * 10/2015 Weiner ..... A47G 27/0275 428/85
2021/0156084 A1 5/2021 Walker
2021/0238785 A1 8/2021 Burgess
2021/0355619 A1 11/2021 Dothard
2022/0346581 A1 * 11/2022 Oakey ..... A47G 27/0275

FOREIGN PATENT DOCUMENTS

EP 2331744 6/2011
FR 2576254 7/1986
GB 2498896 A 7/2013
JP 05300827 11/1993
JP 0742065 A 2/1995
JP 07257260 A 10/1995
JP 0951844 A 2/1997
JP 2004500930 A 1/2004
JP 2005000541 A 1/2005
JP 2005256527 A 9/2005
JP 2006518616 A 8/2006
JP 2008086482 A 4/2008
JP 2012501235 1/2012
RU 2131490 C1 6/1999
WO 0194689 A2 12/2001
WO 03103944 A1 12/2003
WO 2004012108 2/2004
WO 2004067832 A2 8/2004
WO 2006066191 6/2006
WO 2007130118 11/2007
WO 2009059366 A1 5/2009
WO 2010028049 A2 3/2010
WO 2010058027 A2 5/2010
WO 2010144897 12/2010
WO 2012054692 A1 4/2012
WO 2014022466 A1 2/2014
WO 2021141947 7/2021

OTHER PUBLICATIONS

Shaw Contract Group, "Beyond the Fold" Brochure, Oct. 1, 2015, 18 pages.
Mohawk, "Data Tide—Aqua Rhythm, River Code & Biome" Apr. 30, 2021, 3 pages.
Milliken, "Free Flow" brochure, 31 pages, Jun. 2018.
Milliken, "Planks Program" brochure, 12 pages, Jan. 2014.
Milliken, "Color Thesis" brochure, 34 pages, Dec. 2019.
Shaw Contract "Product Catalogue" 289 pages, Jan. 2020.

* cited by examiner

NON-SQUARE RECTANGULAR FLOORING TILES AND METHODS FOR CUTTING SAME

CROSS-REFERENCE TO RELATED APPLICATIONS

This application claims the benefit of U.S. Provisional Application No. 63/183,491, entitled "Non-Square Rectangular Carpet Tiles and Methods for Cutting Same," filed on May 3, 2021, the entire contents of which are hereby incorporated by reference.

FIELD

This invention relates generally to non-square rectangular flooring tiles, such as carpet tiles, and methods of cutting such tiles.

BACKGROUND

Carpet tiles are typically formed by tufting yarn into a backing material to form a tufted face cloth and then attaching the face cloth to a stabilizing structural backing to form a carpet web. The carpet web is then cut into carpet tiles of the desired shape and size.

Designs, patterns, and/or color is imparted to the face cloth via a tufting operation. The tufting machine includes at least one needle bar with a plurality of needles arranged across the bar. A colored yarn is associated with each needle. A backing material is fed under the needle bar, which is reciprocated to drive the needles through and out of the backing material to form loops of yarn or "tufts" in the backing material. As this process continues, the tufts extend across the backing material in generally lateral rows and down the backing material in generally longitudinal columns to form the facecloth of the carpet web.

To impart designs on the face of the carpet web, the needle bar carrying the yarn-bearing needles is capable of limited lateral movement relative to the backing material that can shift the placement of tufts laterally across the backing material. The needles can also be controlled to vary the height of the tufts placed in the backing material. In some tufting machines, multiple needle bars are used to enhance opportunities to create designs. Without these capabilities the resulting product would simply consist of tufts extending in lines of a single color along the length of the backing material. To form a non-striped pattern with the tufts, it is necessary for the needle bar to shift laterally to vary the positioning of the different color tufts in the backing material and to vary the height of the tufts to form the desired design or pattern.

Historically, carpet tiles have been formed by cutting square tiles having a size of 18 inches$^2$ or 50 centimeters$^2$ from a carpet web. However, non-square rectangular carpet tiles are gaining popularity in the market. This application refers to non-square rectangular carpet tiles simply as rectangular carpet tiles. Examples of rectangular carpet tiles are described in U.S. Patent Publication No. 2014/0037885 to Oakey (the '885 application), the entirety of which is herein incorporated by reference.

Rectangular carpet tiles have been formed after tile manufacture by taking the original square tiles and subsequently cutting them in half at some point after tile manufacture. Other rectangular carpet tiles have been formed at the time of manufacture by creating a carpet web as discussed above and then cutting the web into tiles such that vertical/longitudinal cuts Y along the length of the web 1 define the longer edge/dimension L of the rectangular tiles 2 and horizontal/lateral cuts X across the width of the web 1 define the shorter edge/dimension S of the rectangular tiles 2. This "traditional cutting methodology" can be seen in FIG. 1.

Owing to the fabric nature of the carpet web and its tendency to skew out of alignment, it can be difficult to align the web with the knife or other cutting device that cuts the web into tiles. Such a failure of alignment can result in the blade or other cutting device cutting diagonally across—instead of directly along—the carpet web. This can create off-quality tiles by damaging the intended nature of a decorative motif tufted into the face of the carpet along tile edge L, particularly where the motif is striped in nature. For example, narrowing a wide stripe from one end of the rectangular tile to the other end (see, e.g., FIG. 2 where the blue stripe P is wider at the top of the tile 2 and gradually narrows down the length of the tile) or truncating a narrow stripe before it reaches the end of the tile edge can result. This distortion in the intended appearance of the tiles can create tiles that are commercially unfit for installation. The longer the length of the longer edge L of the tile, the more pronounced these distorting effects can be, and the more likely an off-quality tile will result.

What is considered an off-quality tile is partly dependent on the tile pattern. Some patterns are more sensitive to skewing while other patterns are less sensitive to, and thus more forgiving of, such skewing. One method for assessing skewing is determining how many ends of the pattern are cut off along the length of the tile from the top of the tile to the bottom of the tile. How much skewing is acceptable will again depend on the particular pattern, but one rule deems a tile "off-quality" if more than two columns of the pattern are cut off along the tile edge.

Moreover, the traditional cutting methodology for cutting rectangular carpet tiles inhibits the ability to manufacture carpet tiles with yarns from differing dye lots. Carpets are manufactured using colored carpet yarns. The coloring process for these yarns often results in yarns from different dye lots having slightly different shades of the same color during different manufacturing runs, which in turn means that tiles manufactured with the same purported yarn color can look different when placed next to each other on the floor. This problem has created significant logistical problems for manufacturers in managing their manufacturing and product delivery processes (e.g., ensuring that tiles formed with yarns from the same dye lot are delivered to the same customer on a job) and customers (e.g., ordering and storing extra carpet tiles to ensure a supply of replacement tiles formed with yarns of the same dye lot as the installed tiles).

A method for overcoming the dye lot problem in square carpet tiles has been to produce carpet tiles with "mergeable dye lots." This technique involves designing carpet tiles with multiple colors with subtle variation in shade designed into the face of the tile. Because variations of color and shade are designed into the carpet tile from the beginning, differences in shades between dye lots of the same purported color blend into the overall look of the carpet installation instead of having a tile stand out from its neighbors. One example of the use of patterns and colors to enable mergeable dye lots is disclosed in U.S. Pat. No. 6,908,656 to Daniel et al., the entirety of which is incorporated by reference.

However, the traditional cutting methodology for cutting rectangular carpet tiles reduces the opportunity for using the mergeable dye lot solution to address the problem of differing dye lot shades of yarn. Cutting the web so that the shorter dimension S of the tiles extends across the web width renders it more difficult to impart diversity of color to the tiles because there are fewer longitudinal columns of yarn where variations of color and shade can be imparted. The opportunity to vary color across the face of each carpet tile is dictated by the number of longitudinal columns of yarn traversing it surface. The traditional cutting methodology results in relatively few columns of yarn traversing the face of the tiles. This results in relatively few opportunities for color variability. In turn, this undermines the ability to overcome the problem of variable dye lots by using techniques such as mergeable dye lots. Both the off-quality problem and the variable dye lot problem of rectangular carpet tiles are overcome by the present invention. Cutting tiles such that the longer edge L extends across the width of the web and the shorter edge S extends along the length of the web mitigates both of these problems.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention are directed to methods for cutting a carpet web into rectangular carpet tiles such that at least one vertical cut along the length of the carpet web defines a shorter edge of the rectangular carpet tiles and horizontal cuts across the width of the web define the longer edges of the rectangular carpet tiles.

BRIEF DESCRIPTION OF THE DRAWINGS

The disclosure will be readily understood by the following detailed description in conjunction with the accompanying drawings, wherein like reference numerals designate like structural elements. The patent or application file contains at least one drawing executed in color. Copies of this patent or patent application publication with color drawing(s) will be provided by the Office upon request and payment of the necessary fee.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention relate to rectangular carpet tiles and methods of cutting such tiles. While in some embodiments the tiles are manufactured in rectangles approximately ¼ meter wide by one meter long (approximately 25 centimeters by 100 centimeters) or approximately ¼ yard wide by one yard long (approximately 9 inches by 36 inches), the tiles may be of any size provided that one tile dimension (length or width) is smaller than the other (i.e., the tiles are non-square rectangles). In some embodiments, the tiles are cut from the web such that the longer tile dimension (longer edge L) is more than the twice the length of the shorter tile dimension (shorter edge S).

The carpet web from which the tiles are cut can have any pattern, including but not limited to those disclosed in the '885 Application. FIGS. 4A-4D illustrate embodiments of full width web patterns according to the present invention. However, the webs can have any pattern (including no pattern at all—i.e., be of a single or solid color) and can be formed of any color(s) or combination of colors. In use, yarn would be tufted into a backing material so as to create the web pattern on the face cloth. The face cloth would then be attached to a stabilizing structural backing to form a carpet web bearing the web pattern.

Figure 1:
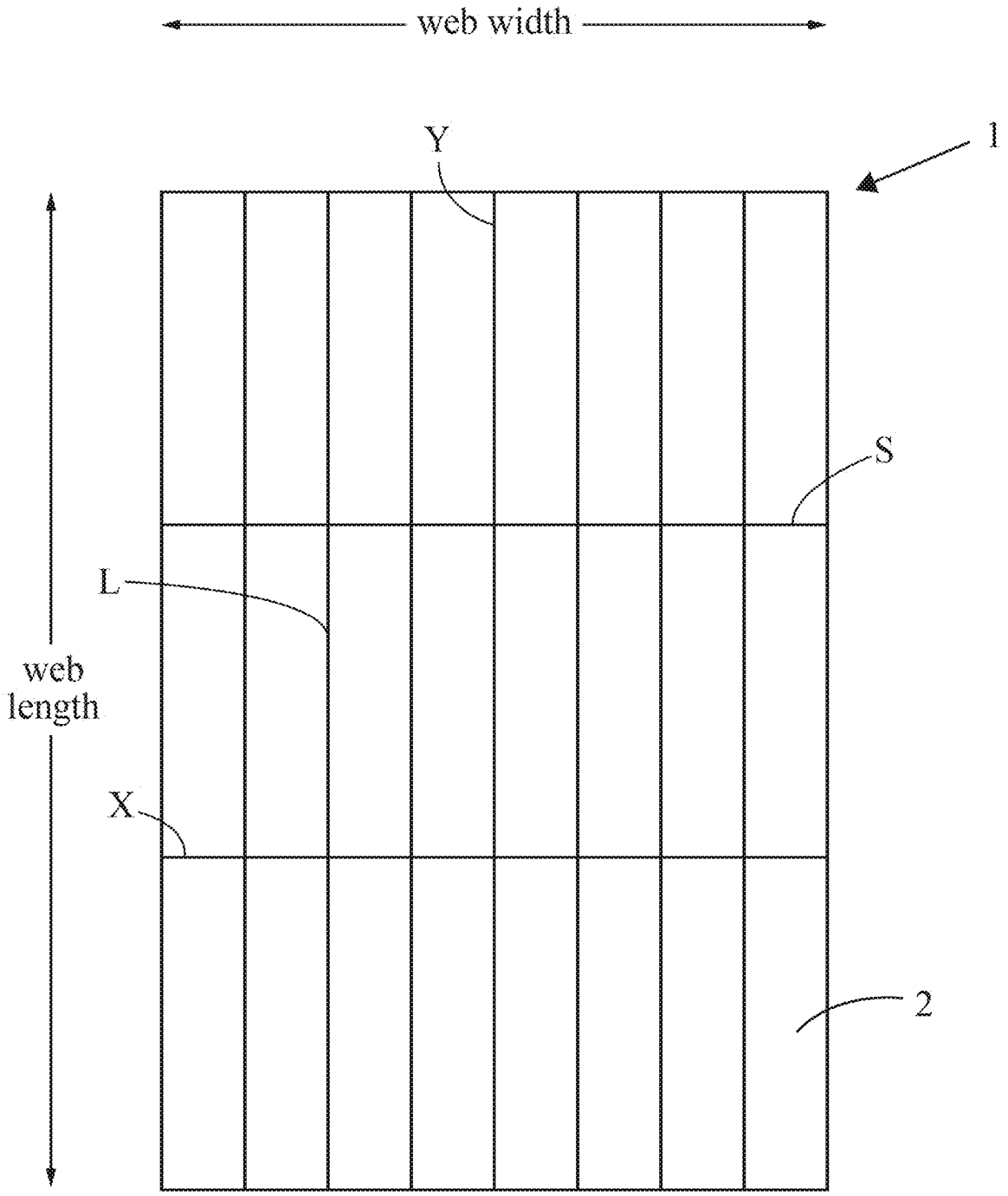
Figure 1 (Prior Art)
FIG. 1 is a top plan view illustrating a traditional cutting methodology for cutting a carpet web into rectangular tiles.
Figure 5:
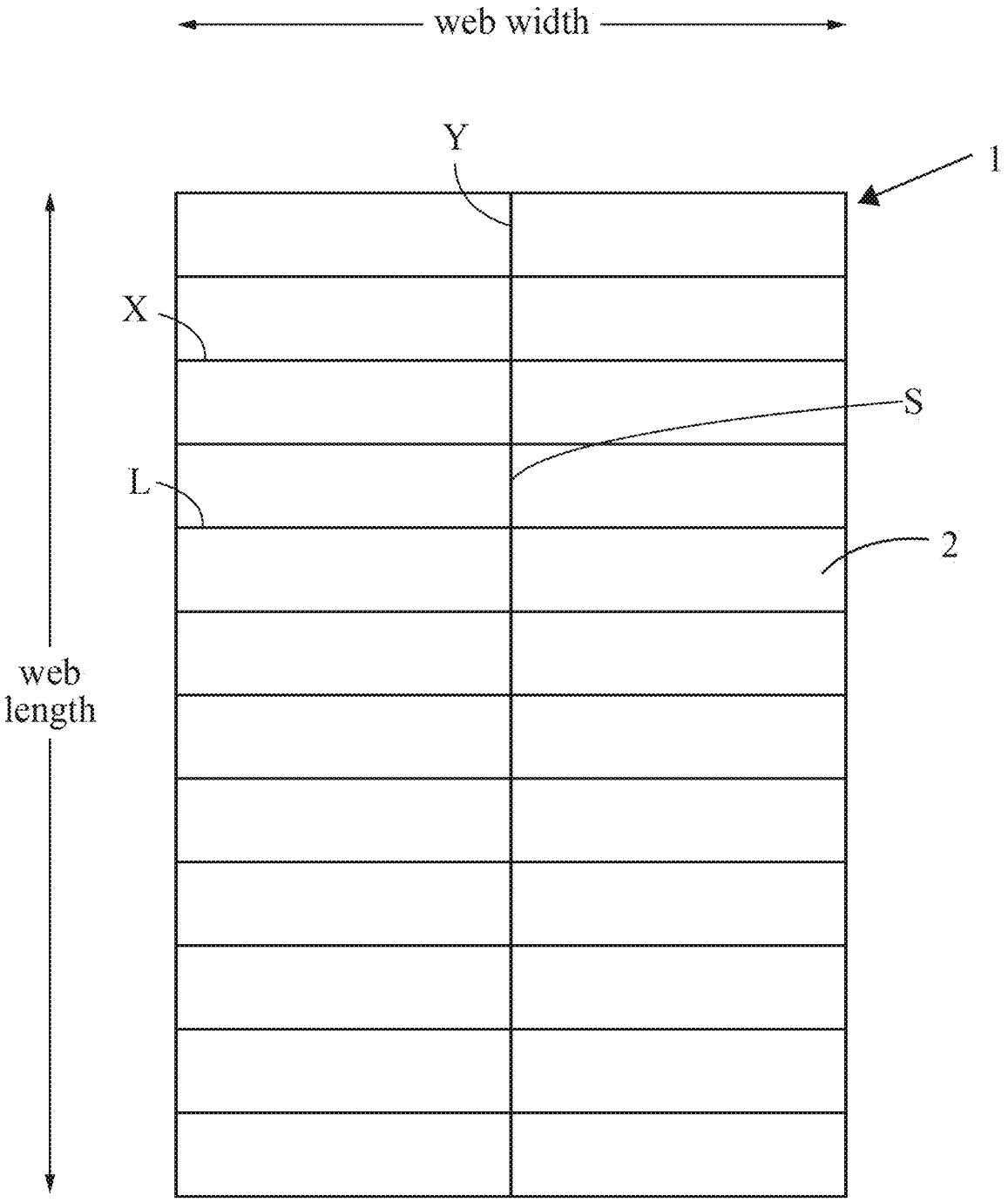
FIG. 5 is a top plan view illustrating an embodiment of the cutting methodology disclosed herein for cutting a carpet web into rectangular tiles.

In contrast to the traditional cutting methodology shown in FIG. 1, the rectangular tiles of this invention are cut from the carpet web 1 such that vertical cuts Y along the length of the web define the shorter edge S of the rectangular tiles 2 and horizontal cuts X across the width of the web define the longer edge L of the rectangular tiles 2. This new cutting methodology can be seen in FIG. 5. Any number of vertical cuts Y and horizontal cuts X may be provided along the length and width of the carpet web 1, depending on the size of the rectangular tiles being cut from the web. Additionally, vertical cuts Y may also be made near one or both side edges of the web 1 to remove selvedge.

Figure 4A:
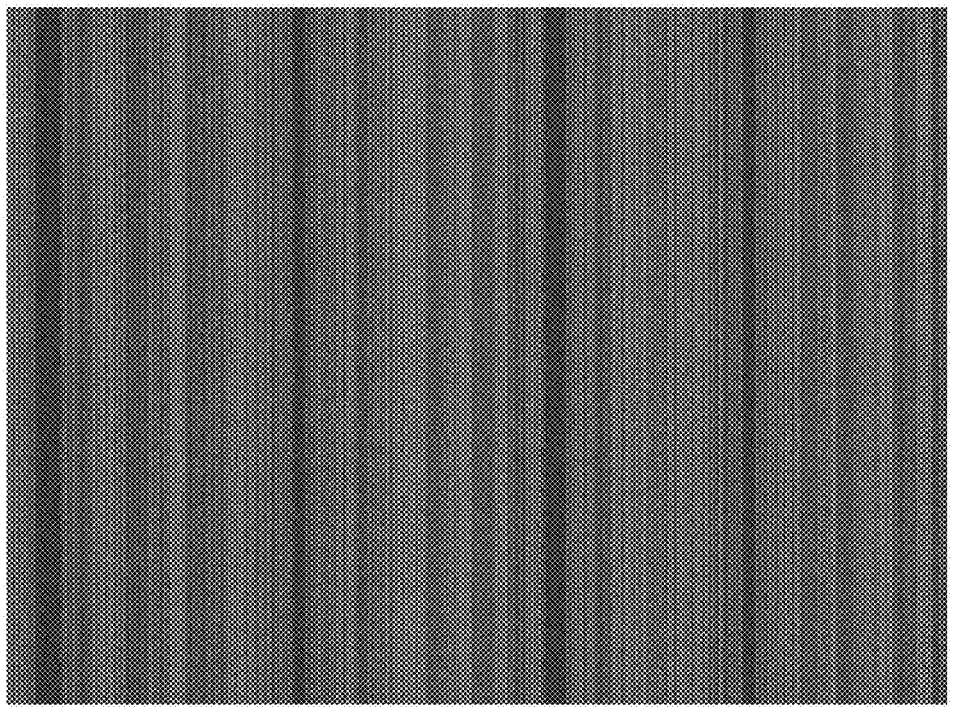
FIGS. 4A-4D are top plan views of carpet web patterns.
Figure 4B:
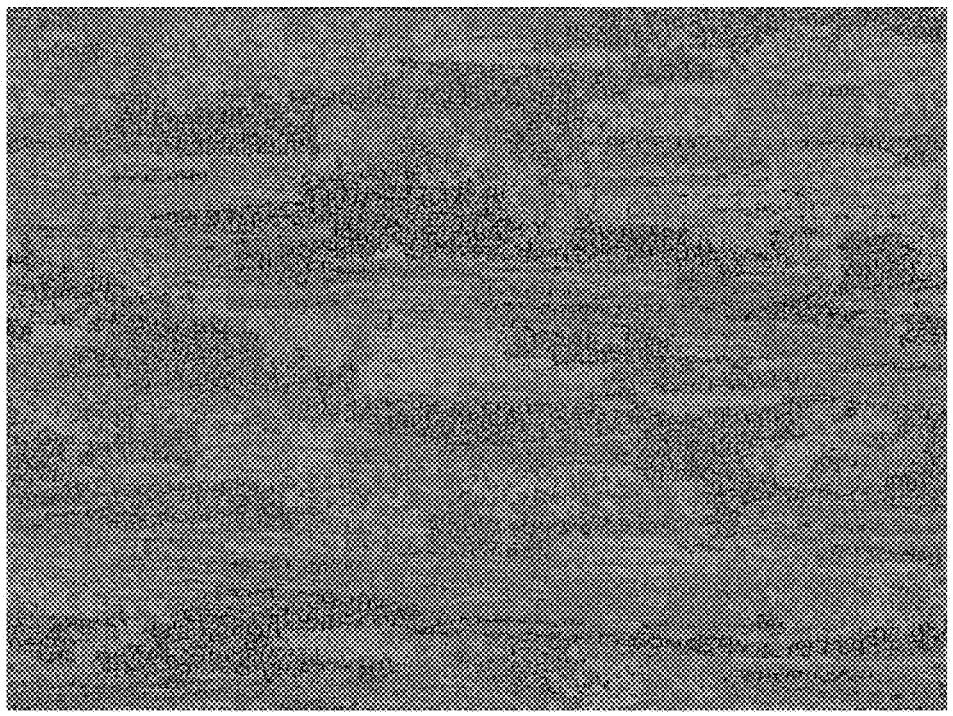
Figure 4C:
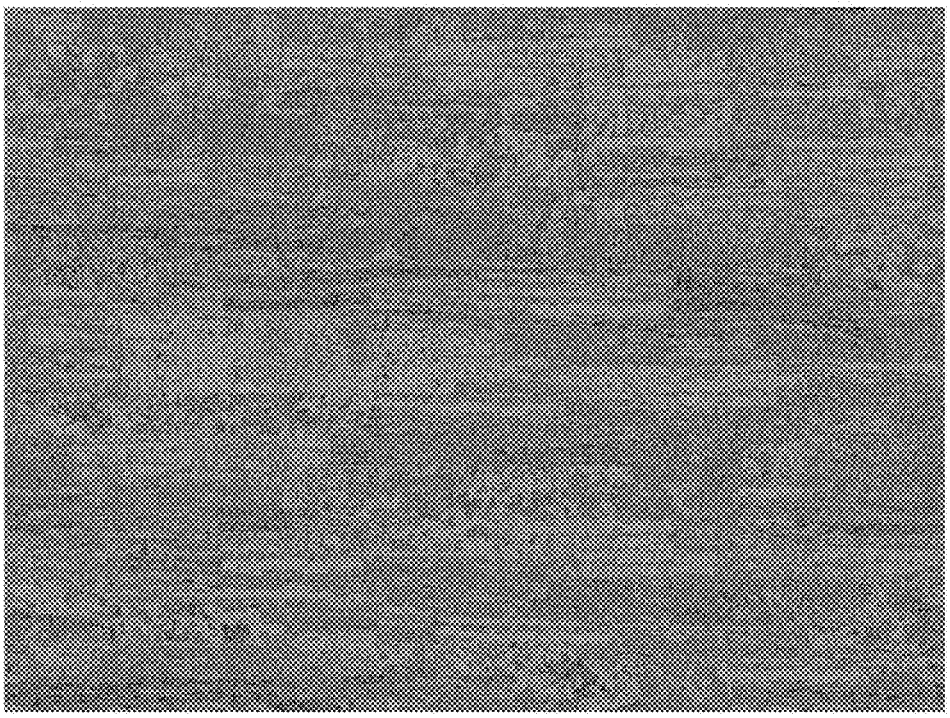
Figure 4D:
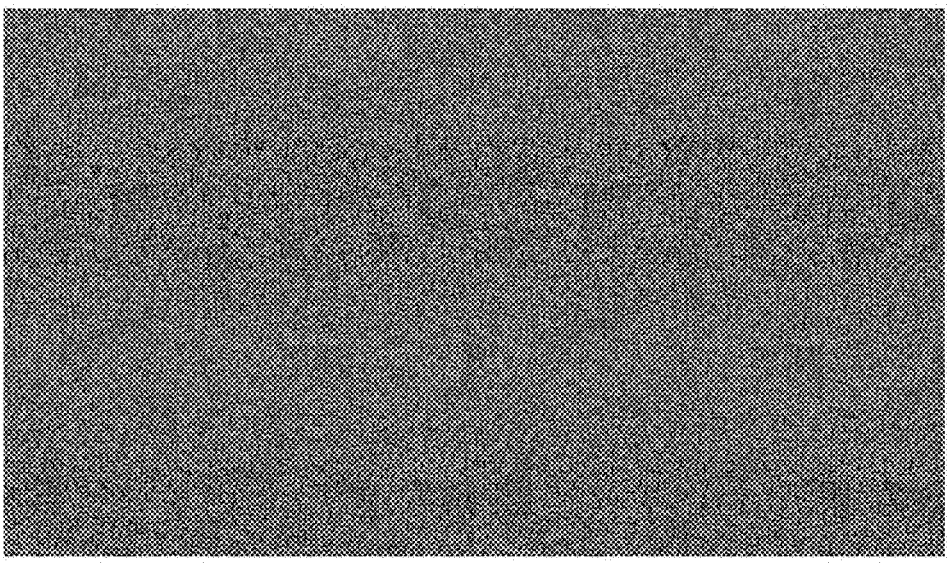
Figure 6:
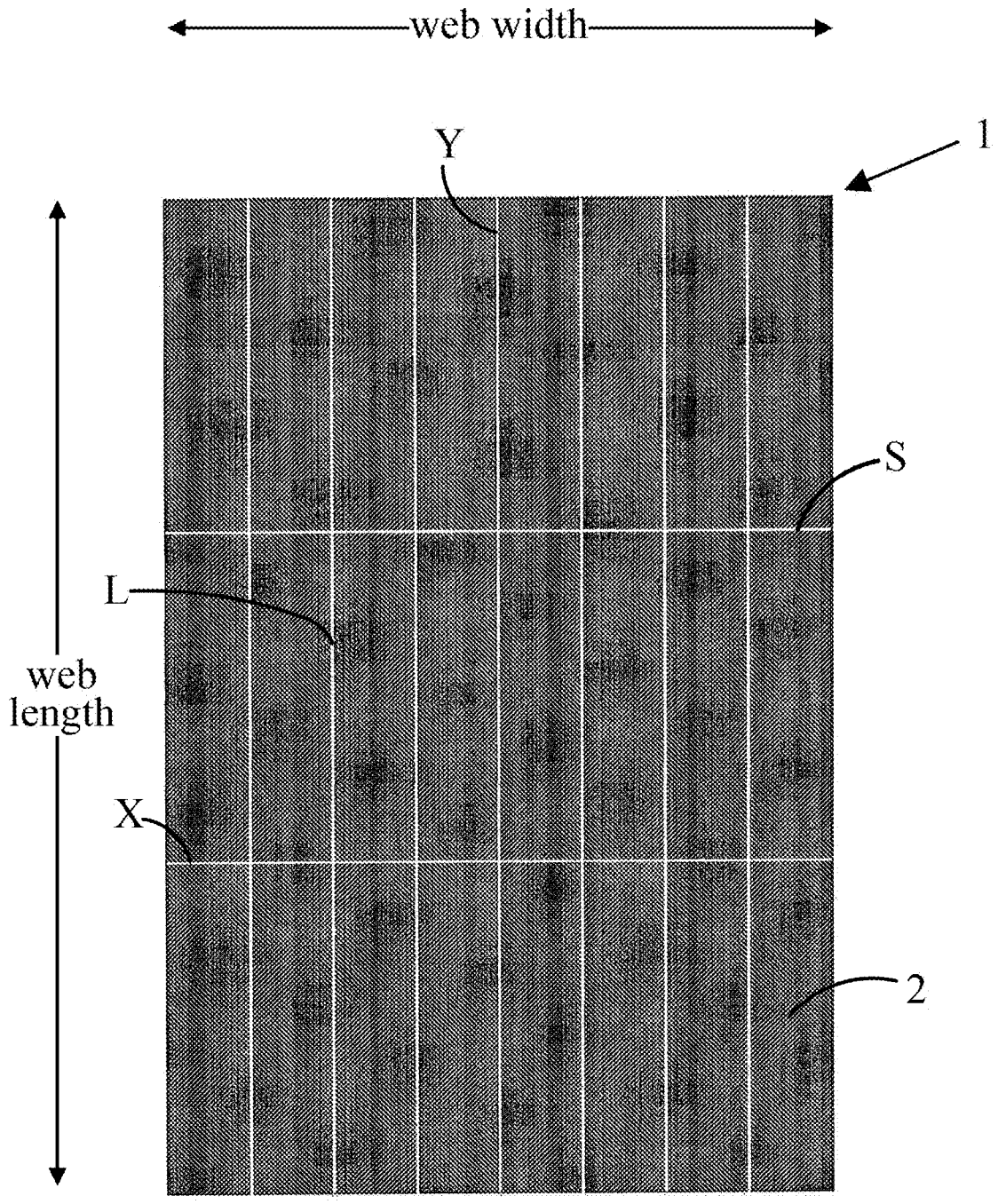
Figure 6 (Prior Art)
FIG. 6 is a top plan view of a carpet web cut using the cutting methodology illustrated in FIG. 1.
Figure 7:
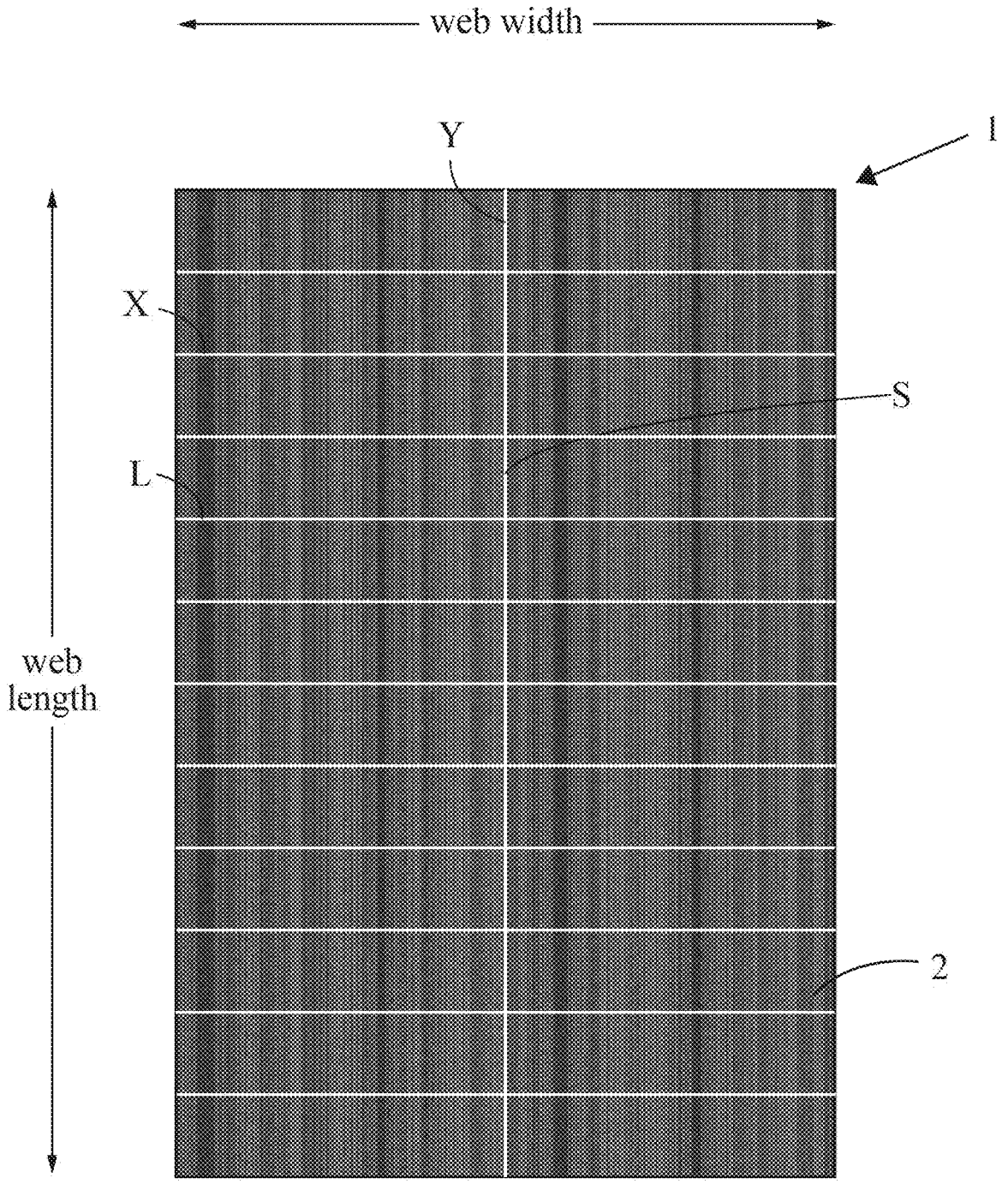
FIG. 7 is a top plan view of a carpet web cut using the cutting methodology illustrated in FIG. 5.

FIGS. 6 and 7 respectively illustrate how the traditional cutting methodology (shown in FIG. 1) and the new cutting methodology (shown in FIG. 5) can be applied to a carpet web bearing the pattern of FIG. 4A (where the white lines represent cuts X and Y).

Figure 2:
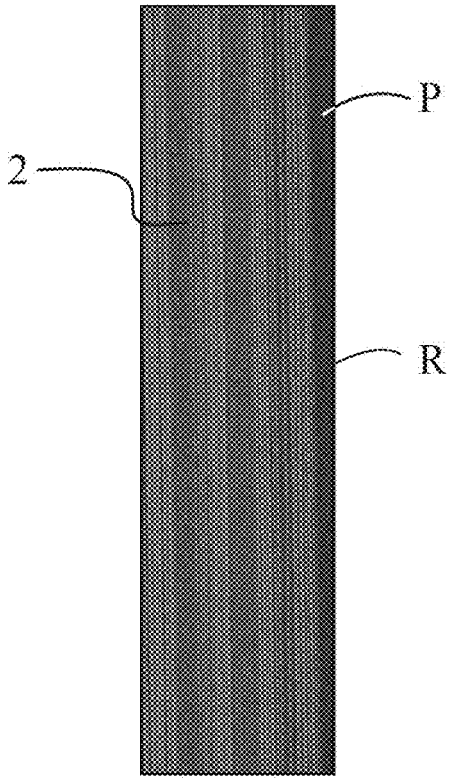
Figure 2 (Prior Art)
FIG. 2 is a top plan view of a tile cut using the methodology illustrated in FIG. 1.
Figure 3:
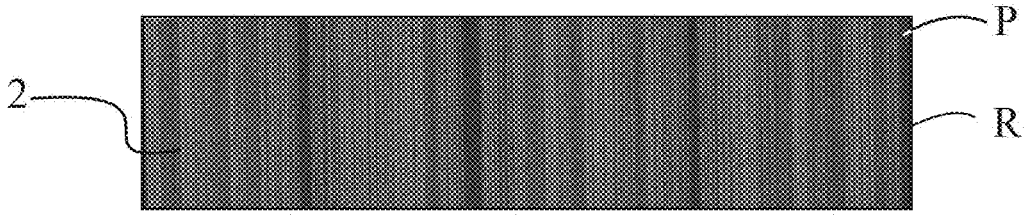
FIG. 3 is a top plan view of a tile cut using an embodiment of the cutting methodology disclosed herein for cutting a carpet web into rectangular tiles.

This new cutting methodology has many benefits over the traditional cutting methodology. To the extent the carpet tiles are being cut from a web bearing a motif sensitive to distortion from skewed cutting as described above, and particularly striped or linear patterns, cutting the short edge S of the tiles vertically from the web reduces the likelihood that skewed cutting will result in an off-quality rectangular tile. For example and assuming a ¼ yard×1 yard tile, cutting the shorter (¼ yard) tile edge vertically along the length of the web confines any skewed cutting to that shorter tile dimension and thereby reduces the chance of skewed cutting creating a defective tile by 75% (e.g., instead of having 1 yard of tile dimension available for skewed cutting, there is now only ¼ yard of tile dimension available for skewed cutting). This benefit is illustrated by a comparison of FIGS. 2 and 3. FIG. 2 illustrates a striped tile cut using the traditional cutting methodology, and FIG. 3 illustrates a striped tile cut using the new cutting methodology. In both tiles, the blue stripe P at the right edge R suffers from skewed cutting, and thus its width gradually decreases along the length of right edge R. However, such narrowing of the stripe width is much more noticeable in FIG. 2, wherein the length of the right edge R (and thus the distance that the stripe P has available for skewing) is four times that of the stripe P in FIG. 3.

The percentage of off-quality 50 $cm^2$ tiles was compared against the percentage of off-quality 1 meter×¼ meter rectangular tiles cut using the traditional cutting methodology. The percentage of off-quality tiles due to unacceptable skewing along the 50 centimeter tile edge (i.e., more than two ends of the pattern being eliminated along the tile edge) was 1.14%, and the percentage of off-quality tiles due to unacceptable skewing along the 1 meter edge was 2.33%. Thus, reducing the tile length by half reduces the number of off-quality tiles due to skewing by more than half.

While patterned tiles are contemplated herein, the new cutting methodology may also be beneficially used on solid (not patterned) rectangular tiles. Solid tiles are typically formed by tufting all of the needles on the needle bar with the same yarn color and not shifting the needle bar during tufting such that each needle tufts a linear row of tufts down the length of the carpet web. If a yarn associated with a needle is defective—e.g., off-color, off-texture, etc.—it can create the appearance of a streak extending down a portion of the length of the carpet web. Reducing the length of the tile dimension extending down the length of the carpet web thus limits the length of the streaking that can occur on the tiles and thus reduces the probability of off-quality rectangular tiles.

Moreover, cutting the web such that the longer edge L of the tiles is cut across the web width creates a broader width upon which color variability can be injected into the tile. Extension of a tile dimension a greater distance across the web width means that more needles that can bear more yarn colors can contribute to the pattern on the tile. In a ¼ yard×1 yard tile, for example, four times the amount of color variation can been introduced into the tile using the new cutting methodology because yarns of varying colors may be introduced along 1 yard of the tile (the longer tile dimension) as opposed to only ¼ yard of the tile (the shorter tile dimension). This broader width enables injection of more color into the tile, more gradual transition of color across the tile, and/or more transitions of colors across the tile. The ability to use more colors in a tile, to more gradually transition color across the tile, and/or to include more color transitions across the tile expands the color palate that may be used on a single tile and thus makes it harder to discern differences in dye lots of the yarns used on a single tile or on tiles within an installation. In this way, the new cutting methodology supports dye lot mergeability of yarns on the tiles in an installation whereby dye lot differences between the yarns on the tiles are virtually, if not entirely, undetectable.

The expanded color palate and enhanced dye lot mergeability of yarns resulting from use of the new cutting methodology to cut rectangular tiles directly from the carpet web far exceeds that resulting from use of the traditional cutting methodology to cut rectangular tiles or from cutting standard square tiles from the carpet web and then subsequently cutting them into other shapes, including rectangular shapes. In the later instance, the dimensions of the original square tile (the edges of which are shorter than the longer edge L of the rectangular tiles cut pursuant to the new cutting methodology) limit the number of colors that can be used in the tile, inhibit the gradual transition of color across the tile, and limit the number of color transitions that can occur across the tile. Thus, smaller tiles cut from the original square tile suffer these same limitations.

Figure 8:
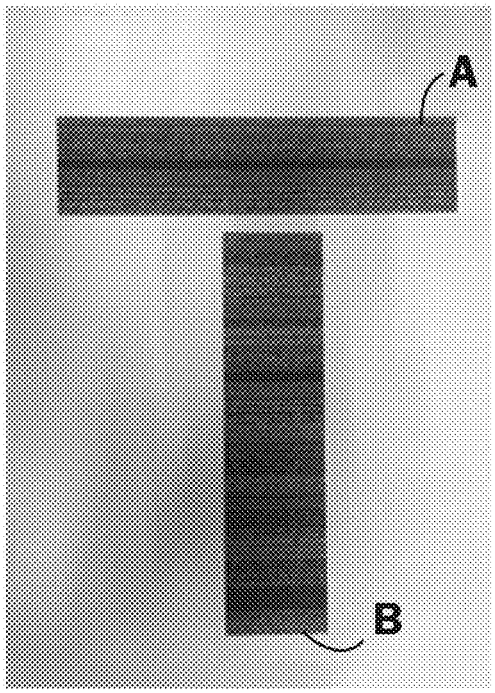
FIGS. 8-15 illustrate carpet tiles, and installations of carpet tiles, cut using the cutting methodology illustrated in FIG. 1 and the cutting methodology illustrated in FIG. 5.
Figure 9:
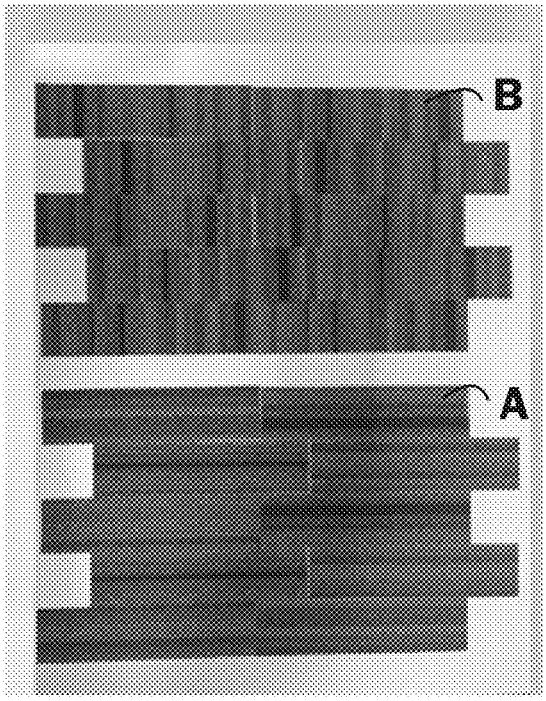
Figure 10:
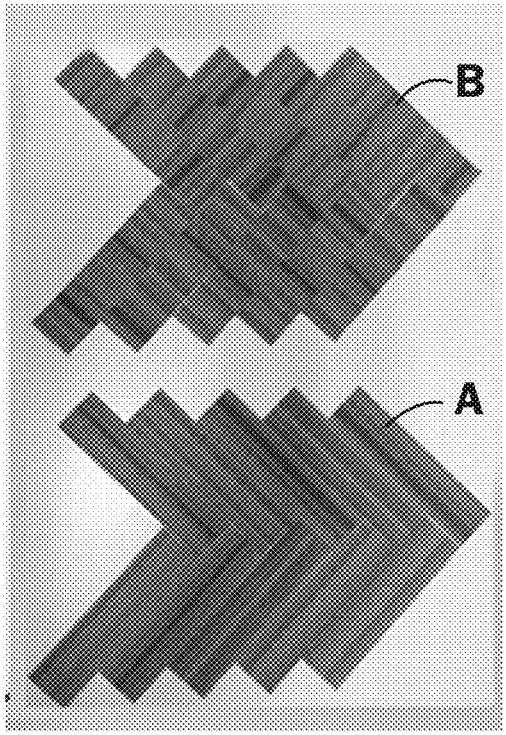
Figure 12:
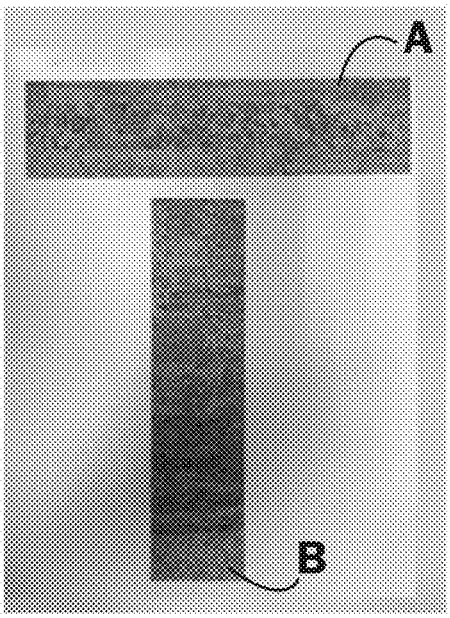
Figure 13:
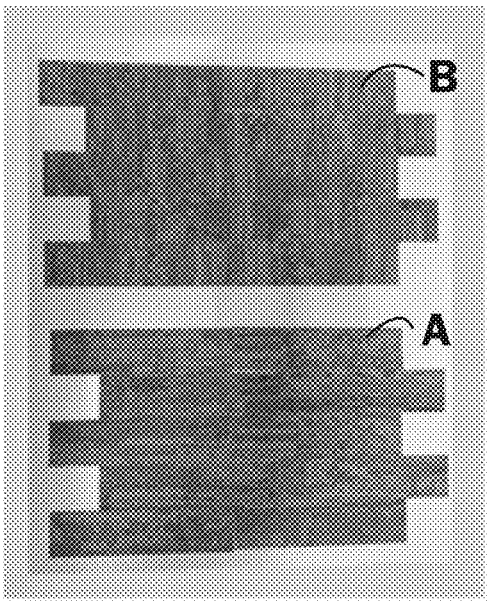
Figure 14:
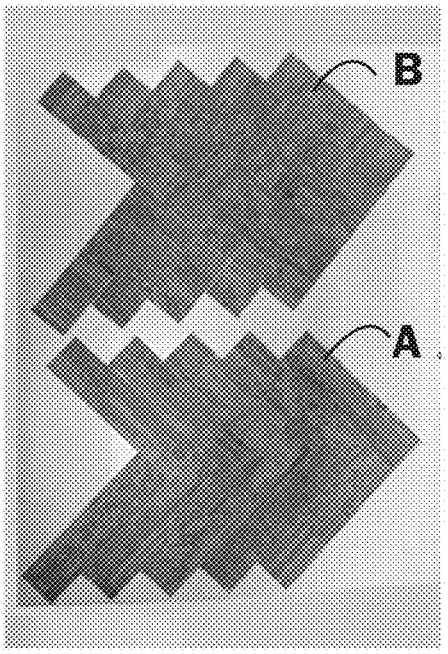

FIGS. 8 and 12 illustrate rectangular carpet tiles cut pursuant to the traditional cutting methodology (tiles A) and rectangular carpet tiles cut pursuant to the new cutting methodology disclosed herein (tiles B). Tiles B include more pattern variation, as well as more transition of color, across the longer dimension of the tiles when compared to tiles A.

Rectangular tiles cut pursuant to the new cutting methodology may be installed using any installation technique, including, but not limited to, being installed in aligned columns and rows, in aligned columns but un-aligned rows (e.g., an ashlar installation), in aligned rows but un-aligned columns (e.g., a brick-laid installation), and in a herringbone pattern. Embodiments of some of the rectangular tiles of this invention may be installed bi-laterally in that all of such tiles in the installation need not be installed in the same rotational orientation they inhabited on the carpet web (i.e., the web orientation); rather the rectangular tiles may be rotated 180° relative to other such tiles in some installations. Such bi-lateral installation reduces installation time and cost by obviating the need for installers to ensure that all of the tiles in an installation are rotationally oriented in the same direction. Moreover, bi-lateral installation reduces tile waste, as discussed below.

Figure 11:
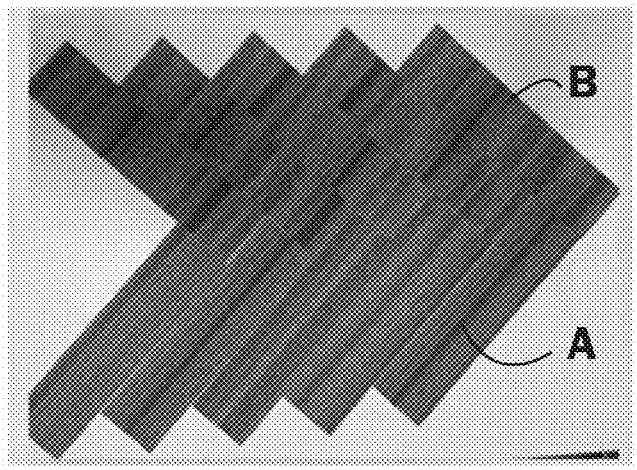
Figure 15:
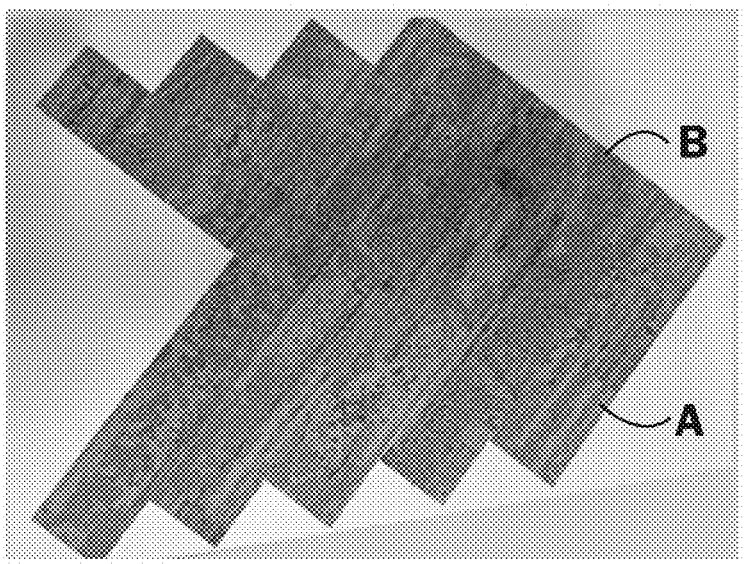

FIGS. 9, 10, 13, and 14 illustrate various installations of rectangular carpet tiles A cut pursuant to the traditional cutting methodology and of rectangular carpet tiles B cut pursuant to the new cutting methodology. Moreover, installations may be created by mixing rectangular tiles cut using the traditional cutting methodology (Tiles A in FIGS. 11 and 15) with rectangular tiles cut using the new cutting methodology (Tiles B in FIGS. 11 and 15).

Typically, carpet tiles are installed by placing them on the floor in the center of a room first and then building the floorcovering outwardly towards the walls. The footprint of a room is rarely an even multiple of the size of the tiles. As a result, tiles installed adjacent the wall often must be cut to size manually on site to fill the space between the wall and an adjacent tile. To ensure the integrity of the seams between the manually cut tile and adjacent carpet tiles, the manually cut tile should be oriented so that the manually cut tile edge faces the wall. This is because manually cut tile edges are typically not as "clean" or straight as the edges formed during tile manufacture. Typically the remaining portion of the cut tile cannot be used and is discarded as waste. However, the ability to install tiles bi-laterally permits usage of the remaining portion of the tile. More specifically, the remaining portion of the tile can be cut further on site (if needed) and rotated 180° so that its manually cut edge is adjacent the wall.

Figure 16:
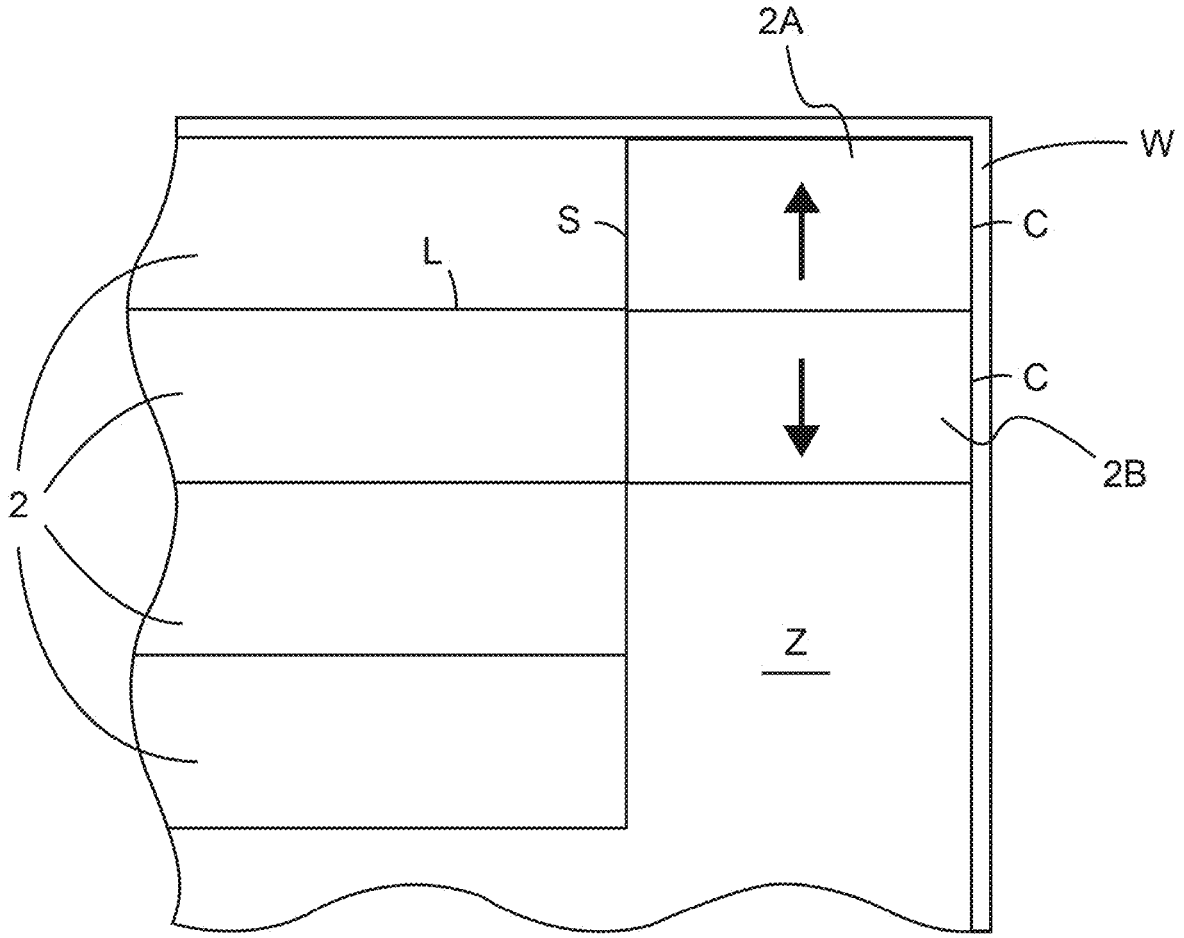
FIG. 16 is a partial top plan view of an installation of carpet tiles cut using the cutting methodology illustrated in FIG. 5.
Figure 17:
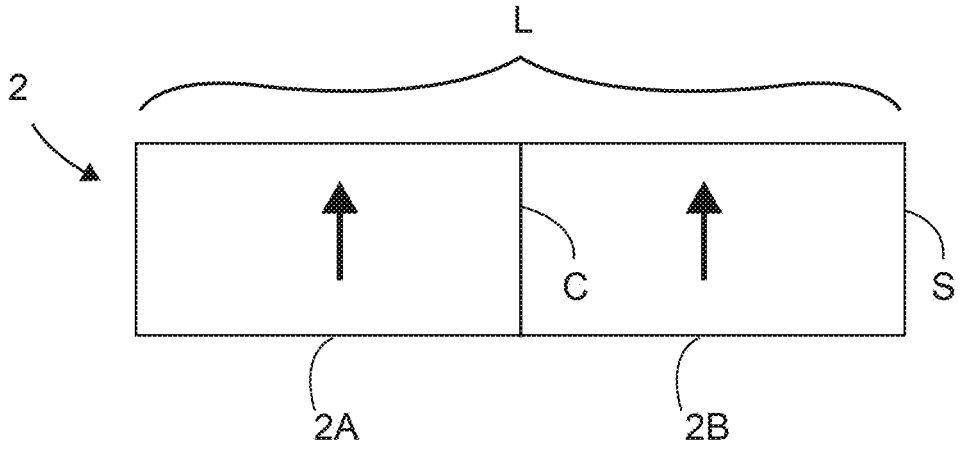
FIG. 17 is a top plan view of a carpet tile cut using the cutting methodology illustrated in FIG. 5.

FIG. 16 illustrate a portion of a tile installation formed by rectangular tiles 2. Each tile 2 includes longer edges L and shorter edges S. A space Z exists between the end of the tiles 2 and the wall W. FIG. 17 illustrates a tile 2 that has been severed by a cut C into two tile portions 2A and 2B. The arrows on the tile 2 indicate the rotational orientation of the tile 2 during manufacture (i.e., its web orientation). As can be seen in FIG. 16, the severed tile of FIG. 17 has been cut so that portions 2A and 2B each fit within the space Z between an adjacent tile 2 and the wall W. Moreover, portion 2B (which heretofore would have been discarded) has been rotated 180° relative to portion 2A to ensure that the manually cut tile edge (formed by cut C) is adjacent the wall where it can be covered by a wall or cove base.

While embodiments of the invention have been disclosed relative to the creation of carpet tiles from carpet webs, the use of the cutting methodologies described herein is not limited to use on carpet webs to create carpet tiles. Rather, the cutting methodologies described herein may be used on any flooring web to create any type of flooring tile, including, but not limited to, vinyl tiles, wood tiles, composite tiles, rubber tiles, cork tiles, etc.

Different arrangements are possible for the components and steps shown in the drawings or described above, and components and steps not shown or described can also be used. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

We claim:

1. A method of manufacturing rectangular carpet tiles each having a first tile edge, a second tile edge opposite the first tile edge, a third tile edge, and a fourth tile edge opposite the third tile edge, wherein the first and second tile edges each have a first edge length and wherein the third and fourth tile edges each have a second edge length more than twice as long as the first edge length, the method comprising:

a. tufting a carpet web having a web width and a web length;

b. cutting at least one rectangular carpet tile directly from the carpet web by:

providing at least one vertical cut along the web length; and providing horizontal cuts that extend across the web width so as to intersect with the at least one vertical cut, wherein a distance between adjacent horizontal cuts substantially equals the first edge length, wherein the at least one vertical cut along the web length defines the first or second tile edge of the at least one rectangular carpet tile, a first of the horizontal cuts defines the third tile edge of the at least one rectangular carpet tile, and a second of the horizontal cuts adjacent the first of the horizontal cuts defines the fourth tile edge of the at least one rectangular carpet tile.

2. The method of claim 1, wherein the first and second of the horizontal cuts respectively define the third and fourth tile edges of only two rectangular carpet tiles.

3. The method of claim 1, wherein the second edge length is approximately four times as long as the first edge length.

4. The method of claim 1, wherein the first and second of the horizontal cuts extend entirely across the web width such that the first of the horizontal cuts defines the third edge of at least two rectangular carpet tiles and the second of the horizontal cuts defines the fourth edge of the at least two rectangular carpet tiles.

5. The method of claim 1, wherein cutting at least one rectangular carpet tile directly from the carpet web comprises cutting a plurality of rectangular carpet tiles directly from the carpet web.

6. The method of claim 1, wherein tufting the carpet web comprises tufting the carpet web with a pattern comprising stripes that extend at least partially along the web length.

7. The method of claim 6, wherein the at least one rectangular carpet tile comprises a pattern comprising stripes that extend entirely between the third tile edge and the fourth tile edge of the at least one rectangular carpet tile.

8. The method of claim 1, wherein tufting the carpet web comprises tufting the carpet web with colored yarns and wherein at least some of the colored yarns are of a same color but are from different dye lots.

9. The method of claim 1, wherein tufting the carpet web comprises tufting the carpet web with yarns of only one color and wherein at least some of the yarns are from different dye lots.

10. A method of manufacturing rectangular flooring tiles each having a first tile edge, a second tile edge opposite the first tile edge, a third tile edge, and a fourth tile edge opposite the third tile edge, wherein the first and second tile edges each have a first edge length and wherein the third and fourth tile edges each have a second edge length more than twice as long as the first edge length, the method comprising cutting at least one rectangular flooring tile directly from a flooring web having a web length and a web width by:

providing at least one vertical cut along the web length; and providing horizontal cuts that extend across the web width so as to intersect with the at least one vertical cut, wherein a distance between adjacent horizontal cuts substantially equals the first edge length, wherein the at least one vertical cut along the web length defines the first or second tile edge of the at least one rectangular flooring tile, a first of the horizontal cuts defines the third tile edge of the at least one rectangular flooring tile, and a second of the horizontal cuts adjacent the first of the horizontal cuts defines the fourth tile edge of the at least one rectangular flooring tile.

11. The method of claim 10, wherein the first and second of the horizontal cuts respectively define the third and fourth tile edges of only two rectangular flooring tiles.

12. The method of claim 10, wherein the second edge length is approximately four times as long as the first edge length.

13. The method of claim 10, wherein the first and second of the horizontal cuts extend entirely across the web width such that the first of the horizontal cuts defines the third edge of at least two rectangular flooring tiles and the second of the horizontal cuts defines the fourth edge of the at least two rectangular flooring tiles.

14. The method of claim 10, wherein cutting at least one rectangular flooring tile directly from the flooring web comprises cutting a plurality of rectangular flooring tiles directly from the flooring web.

15. The method of claim 10, wherein the at least one rectangular flooring tile comprises at least one of a vinyl tile, a wood tile, a composite tile, a rubber tile, or a cork tile.

16. A method of manufacturing rectangular flooring tiles each having a first tile edge, a second tile edge opposite the first tile edge, a third tile edge, and a fourth tile edge opposite the third tile edge, wherein the first and second tile edges each have a first edge length and wherein the third and fourth tile edges each have a second edge length more than twice as long as the first edge length, the method comprising cutting a first and a second rectangular flooring tile directly from a flooring web having a web length and a web width and a web pattern comprising stripes that extend at least partially along the web length, wherein cutting the first and the second rectangular flooring tile comprises:

providing at least one vertical cut along the web length; and providing horizontal cuts that extend across the web width so as to intersect with the at least one vertical cut, wherein a distance between adjacent horizontal cuts substantially equals the first edge length, wherein the at least one vertical cut along the web length defines the first or second tile edge of each of the first and the second rectangular flooring tile, a first of the horizontal cuts defines the third tile edge of each of the first and the second rectangular flooring tile, and a second of the horizontal cuts adjacent the first of the horizontal cuts defines the fourth tile edge of each of the first and the second rectangular flooring tile, wherein the first and second of the horizontal cuts respectively define the third and fourth tile edges of only the first and the second rectangular flooring tile.

17. The method of claim 16, wherein each of the first and the second rectangular flooring tile comprises a pattern comprising stripes that extend entirely between the third tile edge and the fourth tile edge.

18. The method of claim 16, wherein the second edge length is approximately four times as long as the first edge length.

* * * * *